US008246007B2

(12) United States Patent
Manvel

(10) Patent No.: US 8,246,007 B2
(45) Date of Patent: Aug. 21, 2012

(54) INDICATOR PULL LEAD

(76) Inventor: Marie Manvel, Marina del Rey, CA (US)

( * ) Notice: Subject to any disclaimer, the term of this patent is extended or adjusted under 35 U.S.C. 154(b) by 338 days.

(21) Appl. No.: 12/573,759

(22) Filed: Oct. 5, 2009

(65) Prior Publication Data

US 2011/0079757 A1 Apr. 7, 2011

(51) Int. Cl.
*B66F 19/00* (2006.01)

(52) U.S. Cl. ..... 254/1; 254/47

(58) Field of Classification Search ..... 254/1, DIG. 14, 254/4 R, 47, 129
See application file for complete search history.

(56) References Cited

U.S. PATENT DOCUMENTS

| | | | | |
|---|---|---|---|---|
| 1,406,463 | A | 2/1922 | Kuehner | |
| 1,414,821 | A | 5/1922 | Kuehner | |
| 1,468,169 | A | 9/1923 | Rundell | |
| 1,763,850 | A * | 6/1930 | Holden | 24/116 A |
| 1,894,195 | A | 1/1933 | Pulver | |
| 1,947,113 | A | 2/1934 | Russell | |
| 2,455,893 | A | 12/1948 | Kelly | |
| 2,532,202 | A | 11/1950 | Steinbachner | |
| 2,540,369 | A | 2/1951 | Hume | |
| 2,624,457 | A | 1/1953 | Jablon | |
| 2,678,688 | A | 5/1954 | Dragon | |
| 2,681,545 | A | 6/1954 | Hall | |
| 2,763,981 | A | 9/1956 | Blumstein | |
| 3,386,240 | A | 6/1968 | Blumstein | |
| 3,452,479 | A | 7/1969 | Bentley | |
| 3,590,519 | A | 7/1971 | Spilhaus | |
| 3,599,704 | A | 8/1971 | Woodle | |
| 3,985,037 | A | 10/1976 | Peyser | |
| 4,724,883 | A | 2/1988 | Liebowitz | |
| 5,125,629 | A | 6/1992 | Nishimura | |
| 5,167,268 | A | 12/1992 | Mao | |
| 5,238,043 | A | 8/1993 | Woodring et al. | |
| 5,465,779 | A | 11/1995 | Rozon | |
| 5,595,232 | A | 1/1997 | Benthin | |
| 6,250,359 | B1 | 6/2001 | Lorio et al. | |
| 6,955,208 | B2 | 10/2005 | Kim | |
| 7,363,743 | B2 * | 4/2008 | Morken | 43/44.9 |
| 2004/0244921 | A1 | 12/2004 | Kim | |
| 2005/0120615 | A1 * | 6/2005 | Morken | 43/44.9 |
| 2006/0021381 | A1 | 2/2006 | Richardson | |
| 2011/0079757 | A1 * | 4/2011 | Manvel | 254/1 |

OTHER PUBLICATIONS

International Search Report and Written Opinion for corresponding International Application No. PCT/US2010/051340 dated Dec. 2, 2010, 14 pgs.

* cited by examiner

*Primary Examiner* — Lee D Wilson
(74) *Attorney, Agent, or Firm* — Christie, Parker & Hale, LLP

(57) ABSTRACT

A pull lead indicating a pulling direction of the pull lead for a desired operation of a device, the pull lead comprising: a directional indicator selected from the group consisting of a variation in color, a variation in texture, and combinations thereof, so that a pulling direction is indicated for a desired operation of such device.

45 Claims, 11 Drawing Sheets

INDICATOR PULL LEAD

CROSS-REFERENCE TO RELATED PATENT APPLICATION

The entire content of U.S. patent application Ser. No. 12/424,467, filed on Apr. 15, 2009, in the United States Patent and Trademark Office, is incorporated herein by reference.

FIELD OF THE INVENTION

The present invention relates to a variably colored or textured pull lead used for a device operation to indicate direction, and, more particularly, to indicate pull direction.

BACKGROUND OF THE INVENTION

Window coverings typically use a pull lead, such as a pull cord, a link chain, a bead chain or a ball chain, to rotate a series of vertical or horizontal slats, or open or close the window covering. By pulling on one side of the lead, the slats rotate in one direction, e.g., to the right, or the blinds or curtains open. By pulling on the other side of the lead, the slats rotate in the opposite direction, e.g., to the left, or the blinds or curtains close. Some window coverings have pull leads that are anchored to the floor, to the wall, or to the window casing so that the pull lead may be pulled up or down to operate the window covering.

However, the user has no indication as to which side of the lead will perform the desired operation. The user must randomly choose one side to determine the operation performed by pulling on that side, which may not be the desired operation. The resulting undesired movement of the window covering results in user frustration and wasted time.

In addition to frustrating the operator, pulling the incorrect lead introduces unnecessary wear and tear on the mechanisms of the window covering. For example, if the window covering is opened fully, a pull on the wrong lead stresses the lead and the mechanism because the window covering does not move in response to the downward pulling force.

Further, some users with limited sight or users in darkened rooms may have difficulty observing the pull lead, and some users may have difficulty grasping the pull lead.

Additionally, there are other devices, such as machines and lighting, that are operated with a pull lead, which may be frustrating for the user to operate due to lack of a directional indicator.

SUMMARY OF THE INVENTION

An embodiment of the present invention provides a pull chain indicating a pulling direction of the pull chain for a desired operation of a device. The pull chain includes a plurality of beads including a first bead and a second bead, and a plurality of shanks including a first shank, wherein the first shank couples the first bead to the second bead. At least the first bead includes a directional indicator on a surface of the first bead selected from the group consisting of a variation in color, a variation in texture, and combinations thereof, so that a pulling direction is indicated for a desired operation of such device.

The first bead may include an upper hemisphere and a lower hemisphere, and the directional indicator may include the upper hemisphere having a different appearance or a different texture from the lower hemisphere. Each of the plurality of beads may include the directional indicator. The first bead may be a different color than the second bead. The directional indicator may include an upper hemisphere of the first bead having a first color, and a lower hemisphere of the first bead having a second color.

The directional indicator may include at least one indentation on an upper hemisphere or a lower hemisphere of the first bead. The directional indicator may include a non-slip material. The directional indicator may include a color gradient. The directional indicator may include an object on an upper hemisphere or a lower hemisphere of the first bead. The directional indicator may include a decorative pattern. The directional indicator may include an arrow. The directional indicator may be etched into the surface of the first bead. The directional indicator may include a collar. The directional indicator may include a raised portion. The directional indicator may glow in the dark. The directional indicator may be illuminated.

The directional indicator may include a sleeve about the first bead. The sleeve may be clear. The sleeve may be about at least: the first bead, the second bead, and the shank. The sleeve may include a variation in color. The sleeve may include a variation in texture. The pull chain may further include a third bead, and the sleeve may be about at least the first bead and the third bead so that the first and third beads are coupled by the sleeve.

The variation in color or texture may be on the first bead before the pull chain is assembled. The variation in color or texture on the first bead may be applied after the pull chain is assembled.

A first section of the pull chain may include a first directional indicator to indicate that pulling the first section of the pull chain will result in a first operation of the device, and a second section of the pull chain may include a second directional indicator to indicate that pulling the second section of the pull chain will result in a second operation of the device.

The directional indicator may be on intermittent beads. The directional indicator may be on at least one shank.

Another embodiment of the present invention provides a pull lead indicating a pulling direction of the pull lead for a desired operation of a device. The pull lead includes a directional indicator selected from the group consisting of a variation in color, a variation in texture, and combinations thereof, so that a pulling direction is indicated for a desired operation of such device.

The pull lead may include a bead chain including a plurality of beads including a first bead and a second bead, and a plurality of shanks including a first shank, wherein the first shank couples the first bead to the second bead. At least the first bead may include the directional indicator.

The pull lead may be a pull cord. The pull lead may be a link chain.

The directional indicator may be a sleeve about the pull lead.

A first section of the pull lead may include a first directional indicator to indicate that pulling the first section of the pull lead will result in a first operation of the device, and a second section of the pull lead may include a second directional indicator to indicate that pulling the second section of the pull lead will result in a second operation of the device.

Another embodiment of the present invention provides a method of positioning directional indicators on a pull lead for a device. The method includes: positioning the pull lead in a neutral position so that the device is half way between open and closed; positioning an open directional indicator on a first section of the pull lead in a position that is easily grasped; and positioning a closed directional indicator on a second section of the pull lead at a similar position.

The first shank may further include the directional indicator.

The directional indicator may be positioned at an end of the pull lead.

Another embodiment of the present invention provides, a method of positioning directional indicators on a looped pull chain for a device, the pull chain including a plurality of beads, each bead having a first half and a second half, the method including: applying a directional indicator to the plurality of beads, wherein the directional indicator includes the first half having a different appearance or a different texture from the second half, so that on a first side of the pull chain a first half is on top of the second half and a second side of the pull chain the second half is on top of the first half.

Another embodiment of the present invention provides, a method of positioning directional indicators on a pull chain including a plurality of beads, the method including: cutting a first cut into the pull chain so that the pull chain includes a first cut end and a second cut end; attaching the first cut end to a first end of a first directional indicator; and attaching the second cut end to a second end of the first directional indicator.

The method may further include cutting a second cut into the pull chain so that the pull chain further includes a third cut end and a fourth cut end; attaching the third cut end to a first end of a second directional indicator; and attaching the fourth end to a second end of the second directional indicator.

The first directional indicator may include a receptacle adapted to receive at least two of the plurality of beads of the pull chain.

Another embodiment of the present invention provides a method for positioning a directional indicator on a pull cord for a device, wherein the pull cord includes a directional indicator along a length of the pull cord, the method including: attaching the pull cord to the device so that the directional indicator on a first side of the pull cord indicates a first direction and the directional indicator on a second side of the pull cord indicates a second direction opposite the first direction, wherein pulling the first side of the pull cord performs a first operation on the device and pulling the second side of the pull cord performs a second operation on the device.

DETAILED DESCRIPTION OF THE INVENTION

The detailed description set forth below in connection with the drawings is intended as a description of embodiments of a color and/or texture variability for use with a pull lead in accordance with the present invention and is not intended to represent the only forms in which the invention may be constructed or utilized. It is to be understood that the same or equivalent functions and structures may be accomplished by different embodiments that are also intended to be encompassed within the spirit and scope of the invention. As denoted elsewhere herein, like element numbers indicate like elements or features.

As shown in FIGS. 1 through 4, a variation in color or texture is used on a pull chain, such as a bead chain or a ball chain, to provide a directional indicator to indicate the direction the pull chain should be pulled to operate a window covering or other device as desired. In an embodiment of the present invention, the variation in texture or color is applied in a non-uniform or unbalanced way so as to provide a distinction between upper and lower hemispheres of a bead or ball. The variation in color or texture may be used so an individual may observe or feel which side of the pull chain to pull to achieve the desired effect to open or close a window covering or device, such as a horizontal or "mini" blind, vertical blinds, or curtains. A user would open or close the window covering or other device by grasping a proper side of the pull chain and pulling the pull chain up or down.

Figure 1:
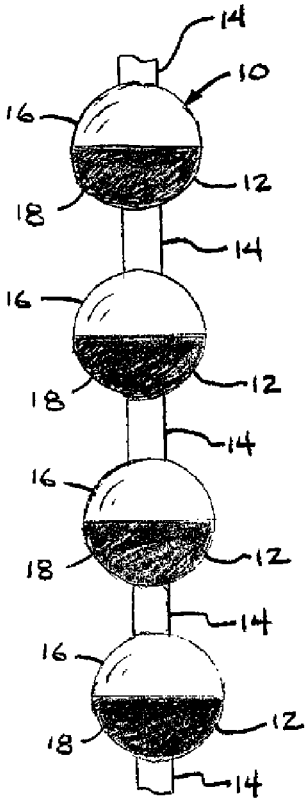
FIG. 1 is a side view of a pull chain according to an embodiment of the present invention.

FIG. 1 shows a length of a pull chain 10. The pull chain 10 is comprised of spherical beads or balls 12 in a line and connected to one another by links or shanks 14. The beads 12 may be formed as hollow metal spheres with openings at the top and bottom. Such beads 12 are then connected to one another by metal links 14 with enlarged ends received within the facing openings of adjacent beads 12. The enlarged ends have a diameter larger than the diameter of the openings so that the beads 12 are captured on the ends of the links 14. Alternatively, the beads 12 may be formed of plastic and located intermittently along a length of cord, which may be made of a woven fiber. Other methods for forming a chain of connected beads 12 may also be used. The beads can also be in shapes other than spherical.

For example, though bead chains come in a number of different sizes, some standard sizes are listed below.

| Standard Size | Bead Diameter (inches) | Shank Diameter (inches) | Approximate Number of Beads per Foot |
|---|---|---|---|
| 3 | 3/32 | 0.020 | 102 |
| 6 | 1/8 | 0.028 | 72 |
| 10 | 3/16 | 0.040 | 50 |
| 13 | 1/4 | 0.060 | 37 |

In the embodiment shown in FIG. 1, an upper hemisphere 16 of each bead 12 is light in color. A lower hemisphere 18 of each bead 12 is darker in color. This color distinction provides a visual signal to a user that pulling the pull chain 10 in an upward direction, toward the lighter colored hemispheres, will open a window covering or other device, whereas pulling the pull chain 10 in a downward direction, toward the darker colored hemispheres, will close the window covering or other device. Various different color combinations, such as white over black or yellow over dark blue, may be used to create the distinction shown in FIG. 1. Moreover, the transition from light color to dark color need not be made at a bright line. Rather, the colors might gradually transition from one to the other.

The directional indicator of FIG. 1 may also be accomplished using distinct textures for the bead hemispheres 16, 18. The distinct texture patterns may be varied as described above for the distinct colors. Moreover, texture distinctions may be used alone to provide a tactile signal to a user along with a more subtle visual signal, or the texture distinctions may be used in combination with color distinctions to provide a tactile signal along with a strong visual signal.

The visual signal, or the textural signal, used on the beads 12 also need not be a simple transition from light to dark, or smooth to rough. Rather, a wide variety of non-uniform patterns may be used that provide a distinctive look and/or feel to one hemisphere of a bead. FIGS. 2A through 2D illustrate various possible patterns that might be used. The patterns shown in FIGS. 2A through 2D are not intended to be exhaustive. Rather, a person of ordinary skill in the art would understand that a wide variety of different patterns could be used that would aid in designating the direction to pull a pull chain 10.

Figure 2A:
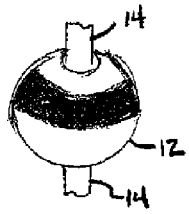
FIG. 2A is a perspective view of a pull chain according to another embodiment of the present invention.
Figure 2B:
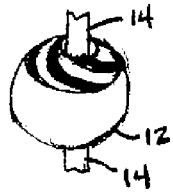
FIG. 2B is a perspective view of a pull chain according to another embodiment of the present invention.
Figure 2C:
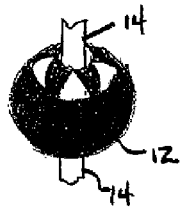
FIG. 2C is a perspective view of a pull chain according to another embodiment of the present invention.
Figure 2D:
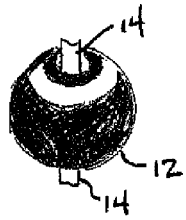
FIG. 2D is a perspective view of a pull chain according to another embodiment of the present invention.

For example, FIG. 2A shows a band, or visual collar, of a darker color on a top hemisphere of a lighter colored bead 12. In another example, FIG. 2B shows a darker colored spiral pattern on a top hemisphere of a lighter colored bead 12. Another example shown in FIG. 2C has lighter triangles on a top hemisphere of a darker colored bead 12. Further, FIG. 2D shows a band, or a visual collar, of a lighter color on a top hemisphere of a darker colored bead 12.

Figure 3A:
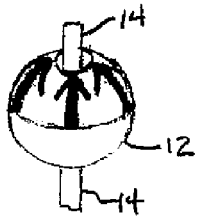
FIG. 3A is a perspective view of a pull chain with a symbolic indicator on a ball or bead according to an embodiment of the present invention.
Figure 3B:
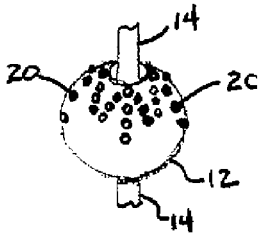
FIG. 3B is a perspective view of a pull chain with a symbolic indicator on a ball or bead according to another embodiment of the present invention.

The visual signal used to indicate direction may also incorporate symbols, such as, for example, arrows. FIG. 3A shows an embodiment of the present invention where arrows have been marked on the outer surface of a bead 12. FIG. 3B shows an alternative embodiment where openings 20, which may be indentations, have been stamped in a bead 12 in a pattern that forms arrows on the bead 12. Other configurations can also be adopted for the openings 20. Star shaped openings, moon shaped openings, etc. could be used. Symbols other than arrows may be used. The symbols may also be incorporated into a bead 12 in a number of other ways. For example, the symbols may be etched onto a bead 12 surface, adhesively or otherwise attached to the outer surface of a bead 12, or embedded into the bead 12, and the symbols may glow in the dark.

Figure 4:
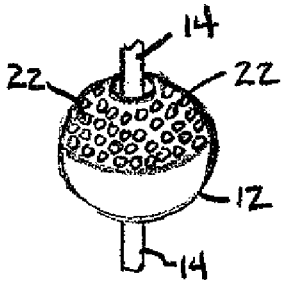
FIG. 4 is a perspective view of a pull chain using an applied texture according to an embodiment of the present invention.

A visually and texturally distinctive pattern may also be formed by applying sequins or rhinestones to the outer surface of a bead 12. FIG. 4 shows a bead where rhinestones 22 have been applied to the upper hemisphere of a bead 12. Other distinctive elements could also be used. The distinctive elements may also be applied in a wide variety of patterns and/or symbols to designate a direction for operation of the pull chain 10.

The texture variation or texture gradation may be formed when the bead or ball is manufactured or applied later. The design may be plastic or metal.

In an embodiment of the present invention, the visual or texture indicator is brushed or painted on one hemisphere after manufacturing. If applied, it may be any other suitable material, such as composites, recycled materials, silicone, or latex rubber. In other embodiments of the present invention, the decoration texture or coloration may be other shapes, including, but not limited to, an arrow, an elliptical or round shape, or a multi-faceted shape.

The indicator may also be scratched or marked on the bead 12, or indicated with grooves made into the bead 12.

The indicator may be stamped on the bead 12.

The indicator may also be placed on both hemispheres of the bead 12, each distinct from the other to indicate direction.

The color pattern, or any other directional pattern, on the beads 12 may be applied to the beads 12 over the entire length of the pull chain 10. Alternatively, the color pattern may be applied to intermittent beads 12, such as every other bead, with sufficient regularity that the overall pattern is still visible to a user. In yet another alternative, the color pattern may be applied to a select length of the beads 12 at a position along the overall pull chain 10 where a user is likely to grasp the pull chain 10 during operation.

According to another embodiment of the present invention, the indicating hemisphere of the pull chain 10 may also have a collar, wherein the collar is thicker on the side of the hemisphere that is the indicator of the bead. The collar can also be made of a glow in the dark material, to provide further directional indication.

According to another embodiment of the present invention, the opening of the collar at the shaft end of the bead may have varying diameters so that it does not cover the entire hemisphere.

In an alternate embodiment, the integral outer side surfaces of the beads 12 may be composed of an anti-slip material. Further, the softer plastic or anti-slip material may not cover the entire outer surface of the pull chain 10, and may be formed in strips, circumferential ridges, or other patterns on the pull chain 10.

In another embodiment of the present invention, a first section of the pull chain 10 that is pulled to operate the window covering or other device has a first indicator, such as a phrase, arrow, ridge, or dot, on at least one bead 12 to indicate to the user that the pull chain 10 should be pulled a particular direction, up or down, to operate the window covering or other device, such as to raise a curtain. A second section of the pull chain 10 has a second indicator, such as a phrase, arrow, ridge, or dot, on at least one bead 12 to indicate to the user that the pull chain 10 should be pulled a particular direction, up or down, to operate the window covering or other device in the opposite manner, such as to lower a curtain. Thus, once a user ascertains which direction a pull chain 10 should be pulled for proper operation, the pull chain 10 can be assembled with the directional indicator pointing the proper direction.

In another embodiment of the present invention, a pull chain 10 may include a raised portion on the pull chain 10 to indicate direction. The raised portion may be shaped in any suitable shape, such as a round shape or an arrow shape.

Figure 5A:
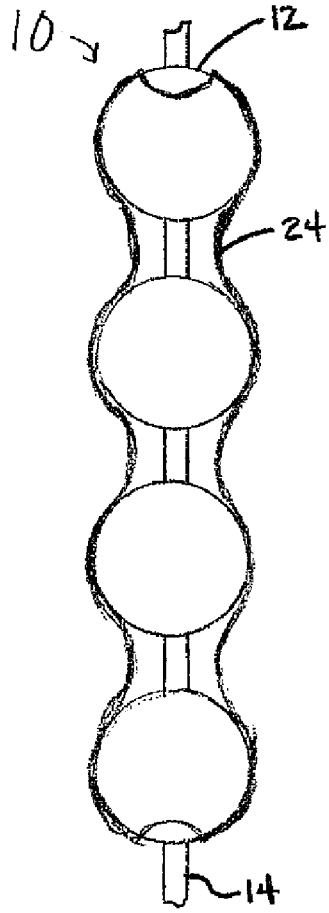
FIG. 5A is a side view of a pull chain using a sleeve according to an embodiment of the present invention.

As shown in FIG. 5A, a visually distinctive pattern or symbol may also be applied to one or more beads 12 by placing a covering or sleeve 24 over the one or more beads 12. In such an embodiment, the pattern or symbol would be on the covering or sleeve 24. Texture patterns, a color gradient, or symbols may also be used on a sleeve. FIG. 5A shows a sleeve 24 that has been applied over a plurality of beads 12. The sleeve 24 is shown as transparent for ease in showing the relationship of the various elements, but it need not be transparent.

Figure 5B:
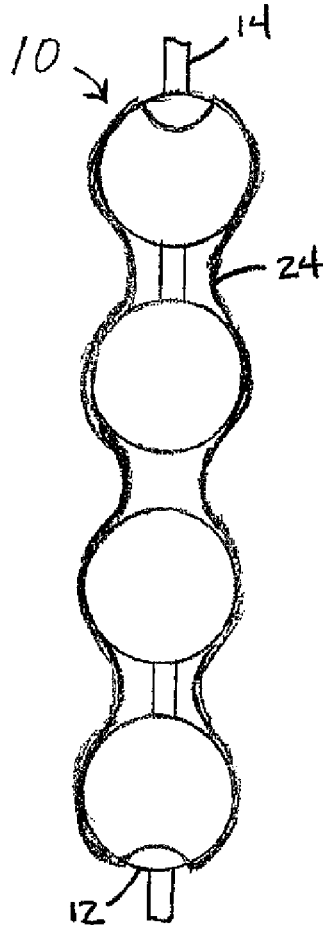
FIG. 5B is a side view of a pull chain using a sleeve according to another embodiment of the present invention.

It is often necessary to form a pull chain 10 in a loop for use with a window covering system or other device. To create such a loop, the ends of a bead chain are connected to one another. In FIG. 5B, an embodiment is shown where the sleeve 24 used to provide a directional indicator is also used to hold the ends of a pull chain 10 together.

According to another embodiment of the present invention as shown in FIGS. 5A and 5B, the sleeve 24 may be a foam, rubber, composite or other suitable material. Here, the sleeve 24 may either be positioned about the pull chain 10 after the pull chain 10 is assembled, or the sleeve 24 may be affixed in parts to each section of the pull chain 10 so that the sleeve 24 remains on the pull chain 10 when the pull chain 10 is disassembled. The sleeve material may be selected to provide a softer gripping surface or an anti-slip surface. Since some pull chains 10 are anchored with a pulley mechanism or other safety device, described below in more detail, the sleeve 24 may be constructed to be resilient and sturdy enough to be pulled through these types of mechanisms without damage.

In another example, the sleeve 24 may be an outer shell formed of a clear material, such as plastic, and may be positioned about a length of the pull chain 10, about a bead, about a shank (or connector between beads), or about multiple shanks (or connectors between beads). The clear material may be a hard plastic or it may be a flexible plastic. The clear material may also incorporate colored or decorative elements such as a colored dye or sparkles. These decorative elements may be arranged to indicate a direction that the pull chain 10 should be pulled.

In another embodiment of the present invention, a length of pull chain 10 may include a light colored pull chain section and a dark colored pull chain section. According to this embodiment of the invention, a user should pull the light colored pull chain section to open the window covering or other device, such as to raise the curtain or rotate the blinds into an open position. A user should pull the dark colored pull chain section to close the window covering or other device, such as to lower the curtain or rotate the blinds into a closed position.

In another embodiment of the present invention, there is a gradation of the colors, or a gradation in a glow-in-the-dark material, along the pull chain 10 from lighter to darker. This would signal to a user that they should pull the darker section of the pull chain 10 to close and the lighter section of the pull chain 10 to open.

In another embodiment of the present invention, a pull chain 10 may have a light to dark color gradient, or a gradation in a glow-in-the-dark material, from one end of the pull chain 10 to the opposite end of the pull chain 10. For example, once the pull chain 10 is positioned, one side of the bead chain may appear to have a lighter color than the other side of the bead chain. Here, the chain may be fixed to a stationary object, such as the floor or the window casing, by threading the pull chain 10 through a pulley or another suitable device attached to the stationary object. According to this embodiment of the invention, a user should pull the pull chain 10 in the direction of the lighter color of the pull chain 10, which in this example would be pulling up, to open the curtain or blind. A user should pull the pull chain 10 in the direction of the darker color of the pull chain 10, which in this example would be pulling down, to close the curtain or blind.

The bi-hemisphere, coloring or texture on the pull chain 10 may also be made of or coated with a glow-in-the-dark material, or have a gradation in the glow-in-the-dark material.

Alternatively, the pull chain 10 could be made from a fiber optic material and incorporate a light that would make it easy to see in the dark.

In another embodiment of the present invention, the pull chain 10 may be modified in other ways to achieve a desired appearance. For example, one hemisphere of the bead 12 on a pull chain 10 may be decorated with crystals, or other suitable texturizing elements. Further, the pull chain 10 may be different colors to achieve a desired appearance, or the pull chain 10 may be formed of a clear material, such as an acrylic polymer like Lucite.

In another embodiment of the present invention, the beads 12 may be clear with an internal design or symbol, such as glitter, a flower, or an arrow, that is opaque.

A person of ordinary skilled in the art will appreciate that the beads of the pull chain may be formed into numerous different shapes that would be suitable for different applications. For example, the beads may be shaped like an arrow, a dumbbell, a sphere, a football, or animal or action figure shapes.

In another embodiment of the present invention, the pull chain 10 may be adapted for use in industrial applications, such as for operating warehouse doors or manufacturing machinery. For example, a pair of pull chains, with one pull chain being green and the other pull chain being red, may be used for to operate a warehouse door, so that pulling the green pull chain opens the door and pulling the red pull chain closes the door. In another example, pulling the green pull chain may start a piece of machinery and pulling the red pull chain may stop a piece of machinery.

In another embodiment of the present invention, the pull chain 10 may be colored red to indicate that it may be used in an emergency situation, such as an emergency chemical shower.

In another embodiment of the present invention, one or both hemispheres of the pull chain 10 may be illuminated, such as with an LED light or other suitable light source, or reflective for situations where light or reflections may be desired.

In other embodiments of the present invention, the pull chain 10 may be formed of multiple materials. For example, the pull chain 10 may be formed of a hard plastic and may have sections, such as grip strips, that are formed of a rubber material for ease of gripping the pull chain 10.

Figure 6A:
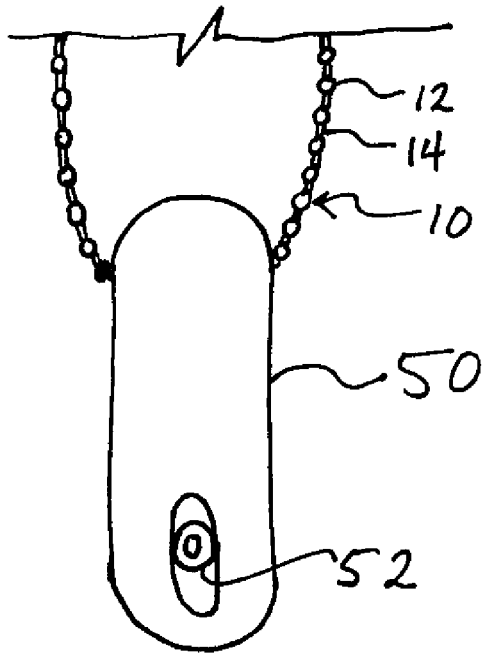
FIG. 6A is a front view of a pull chain with a safety device according to an embodiment of the present invention.
Figure 6B:
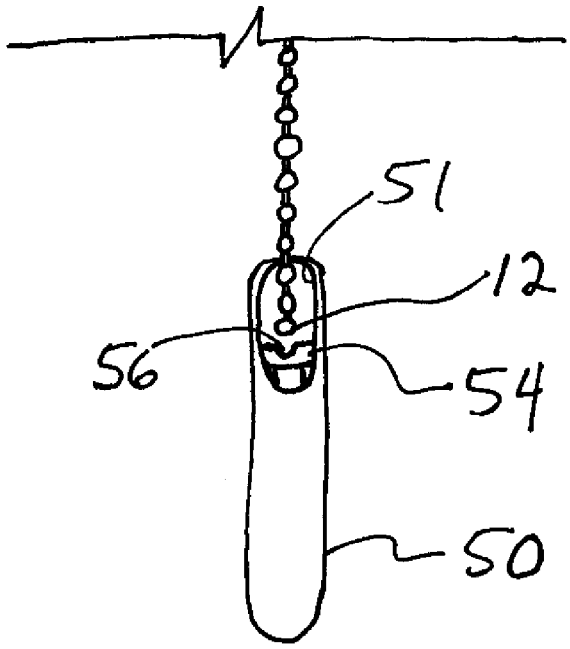
FIG. 6B is a side view of the pull chain with the safety device of FIG. 6A.

In another embodiment of the present invention, see FIGS. 6A and 6B, a safety device 50, such as that available from Hunter Douglas under the name Universal Cord Tensioner, may be utilized with the pull chain 10. Here, the safety device 50 may be mounted to a wall, or another fixed surface, by a spring-loaded mounting bracket 52. The pull chain 10 loops through an opening 51 in the body of the safety device 50. When there is no pressure on the pull chain 10, a notch 56 in a latch 54, which is connected to the spring-loaded mounting bracket, presses against a link 14 on one or more sides of a bead 12, to prevent movement of the pull chain 10. However, whenever the pull chain 10 is pulled taut, the body of the safety device 50 is pulled up with respect to the fixed spring-loaded mounting bracket 52. The spring-loaded mounting bracket 52 pulls down on the latch 54 so that the bead 12 is released from the notch 56 and the pull chain 10 may then move through the opening 51, to be pulled up or down. Here, the directional indicator on the pull chain 10 is sturdy enough so that the pressure of the notch 56 and the latch 54 do not remove the directional indicator. The directional indicator should also be sized and configured such that it will fit easily through opening 51.

Figure 7A:
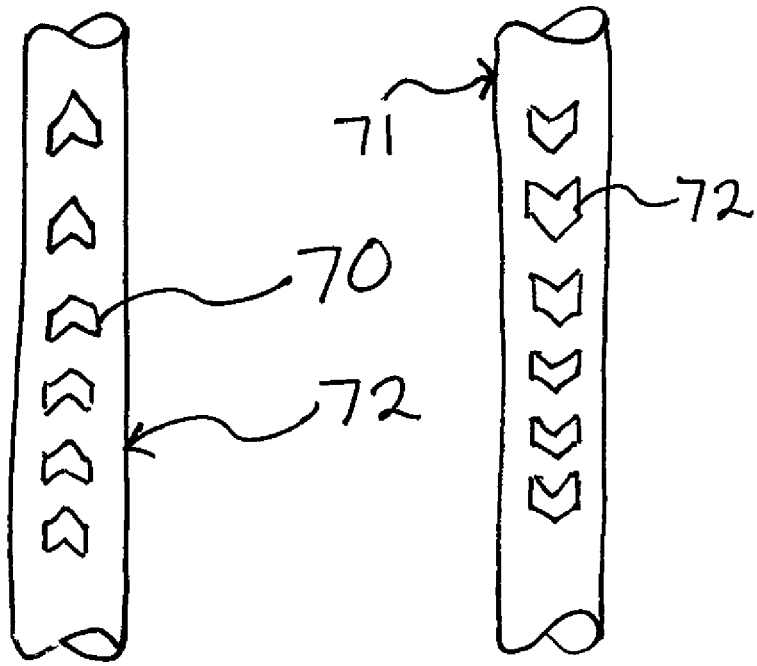
FIG. 7A is a side view of a pull cord according to another embodiment of the present invention.

In another embodiment of the present invention as shown in FIG. 7A, a directional indicator 70 may be incorporated or built into, such as through the weaving process, a pull cord 71, 72, which may be formed of any suitable material, such as cotton, nylon, or plastic. For example, the indicator 70 may be darker colored threads in a light pull cord 71, 72, as shown, or lighter colored threads in a dark pull cord. Further, the indicator 70 and/or the pull cord 71, 72 may be a glow-in-the-dark material or a metallic material. The indicator 70 may also have a variety of shapes, such as an arrow or a phrase. Alternatively, the directional indicator may be wrapped around the pull cord or woven around the pull cord.

Here, the pull cord 71, 72 may be utilized with a pulley on horizontal blinds, so that pulling down a first section of the pull cord 72 results in a front edge of the slats of the blind going up, as indicated by the directional indicator 70 in this section pointing up, and pulling a second section of the pull cord 71 results in a front edge of the slats of the blind going down, as indicated by the directional indicator 70 in this section pointing down. Alternatively, the ends of the pull cord 71, 72 may be loose so that the ends are not connected.

In another embodiment of the present invention, the indicator on the pull cord may be a gradient in color or in a glow-in-the-dark material, so that one portion of the pull cord has a different appearance from another section of the pull cord.

Figure 9:
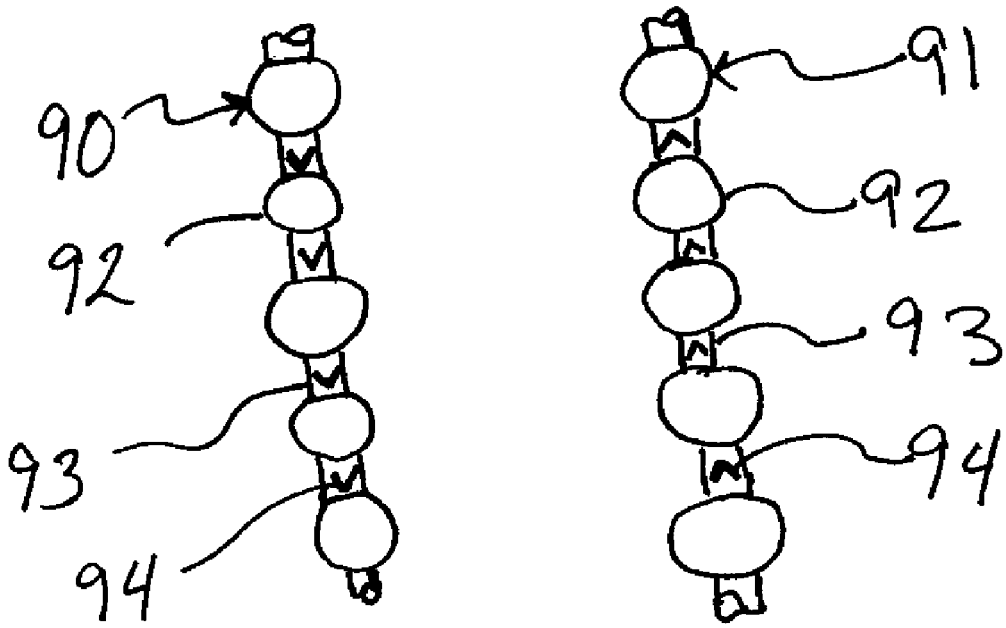
FIG. 9 is a side view of a pull chain according to another embodiment of the present invention.
Figure 10:
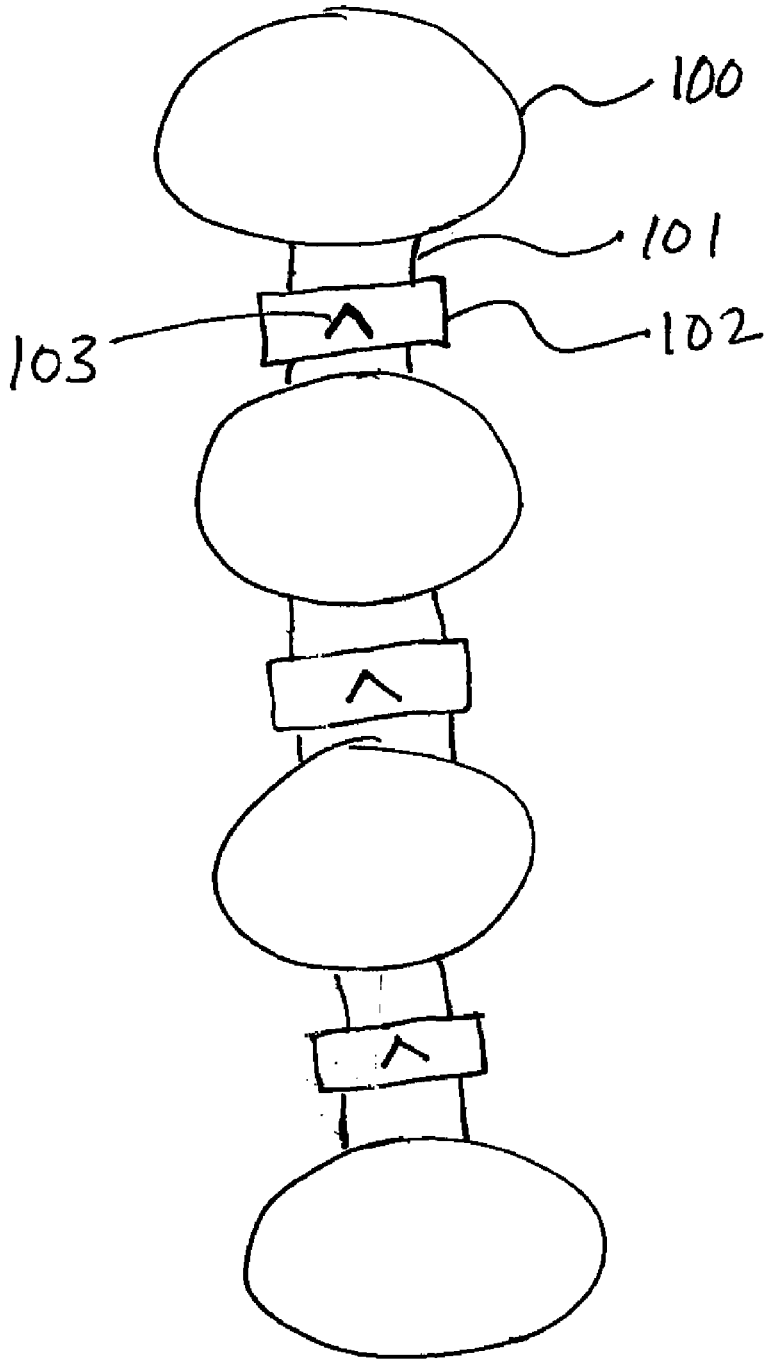
FIG. 10 is a side view of a pull chain according to another embodiment of the present invention.

In another embodiment of the present invention as shown in FIG. 9, the indicators 94, may be utilized on a bead chain 91, 92 where the beads 92 are located on a cord 93, in a similar manner as described above. Here, the indicators 94 would be visible on the cord 93 between the beads 92. Further, if the beads are connected by shanks, rather than a cord, the indicator may be on the shank. Alternatively, an indicator 103 may be placed a collar 102 about the cord or shank 101 between beads 100, as shown in FIG. 10. Here, the collar 102 could be taped on, snapped on, tied on, or affixed to the cord or shank 101 in any other suitable manner. Further, collar 102 could be a ribbon, silicone, or any other suitable material. Also, the collar could include crystals, glitter, or be glow-in-the-dark.

In another embodiment of the present invention, the pull lead may be utilized with a vertical blind, so that pulling down on one side of the pull lead rotates the blinds in one direction and pulling down on the other side of the pull lead rotates the blinds in the other direction.

In another embodiment of the present invention, the pull lead may be utilized to open and close a window covering, rather than rotate blinds, so that pulling down on one side of the pull lead opens the window covering and pulling down on the other side of the pull lead closes the window covering.

In another embodiment of the present invention, the sleeve 24, as described above, may be adapted to be utilized on a pull cord. Here, the width of the sleeve would correspond to the thickness of the pull cord. Further, the sleeve may incorporate any of the features described with respect to sleeve 24 above.

Figure 7B:
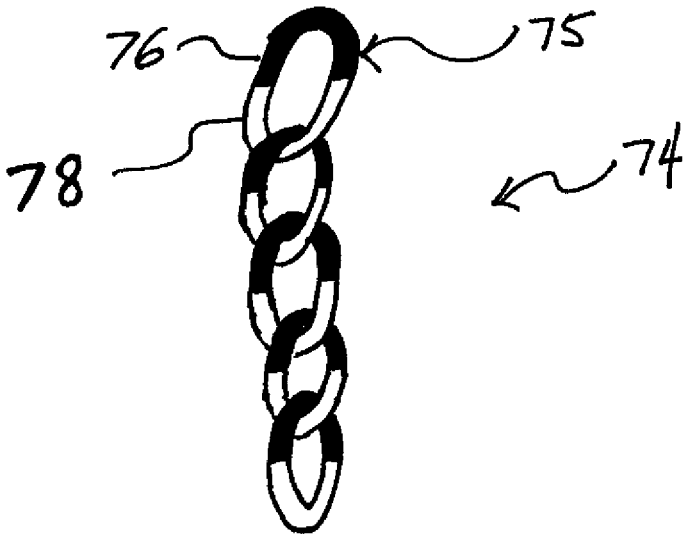
FIG. 7B is a side view of a link chain according to another embodiment of the present invention.

In another embodiment of the present invention as shown in FIG. 7B, a directional indicator may be incorporated into a link chain 74, which may be formed of any suitable material, such as plastic or metal. In one example, each link 75 of the link chain 74 may have a variation in color, with a top portion 76 of the link 75 having a dark color and bottom portion of the link 78 having a light color. However, one of ordinary skill in the art will appreciate that the variations in both appearance and texture described above with respect to the beads of the pull chain may also be adapted to be utilized with the link chain 74. Further, the sleeve, as described in numerous various variations above, may also be adapted for use with the link chain 74.

Figure 8A:
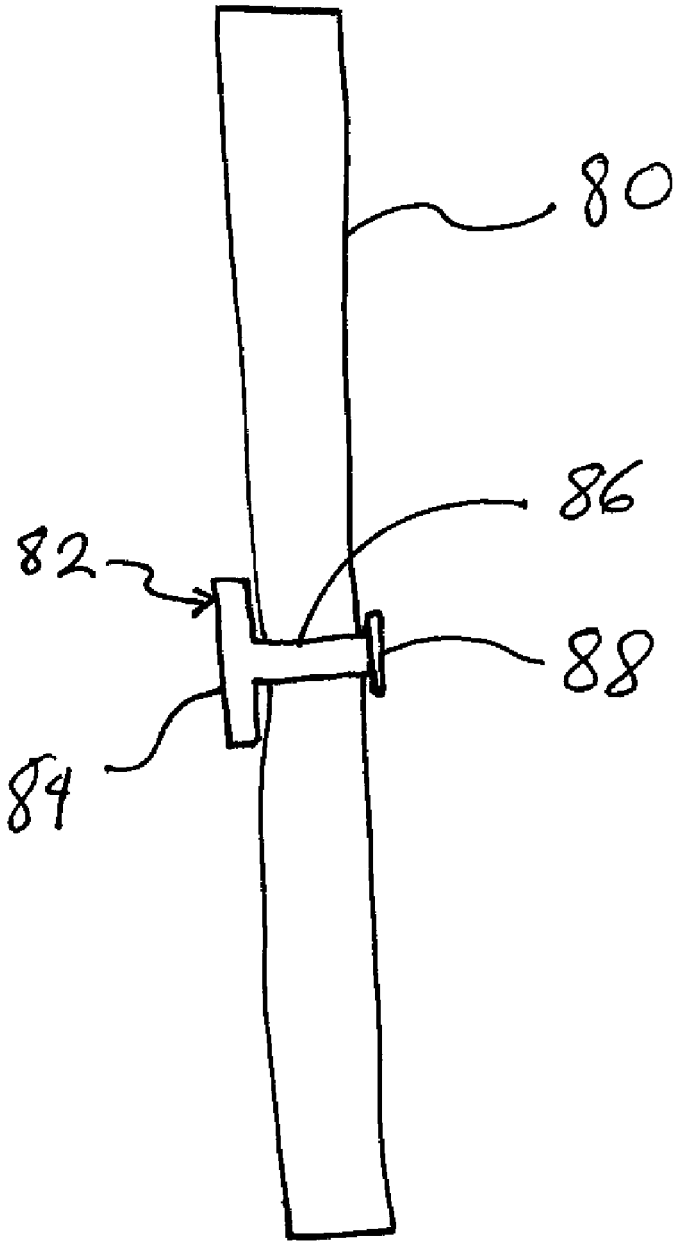
FIG. 8A is a cross-sectional view of a pull cord according to another embodiment of the present invention.
Figure 8B:
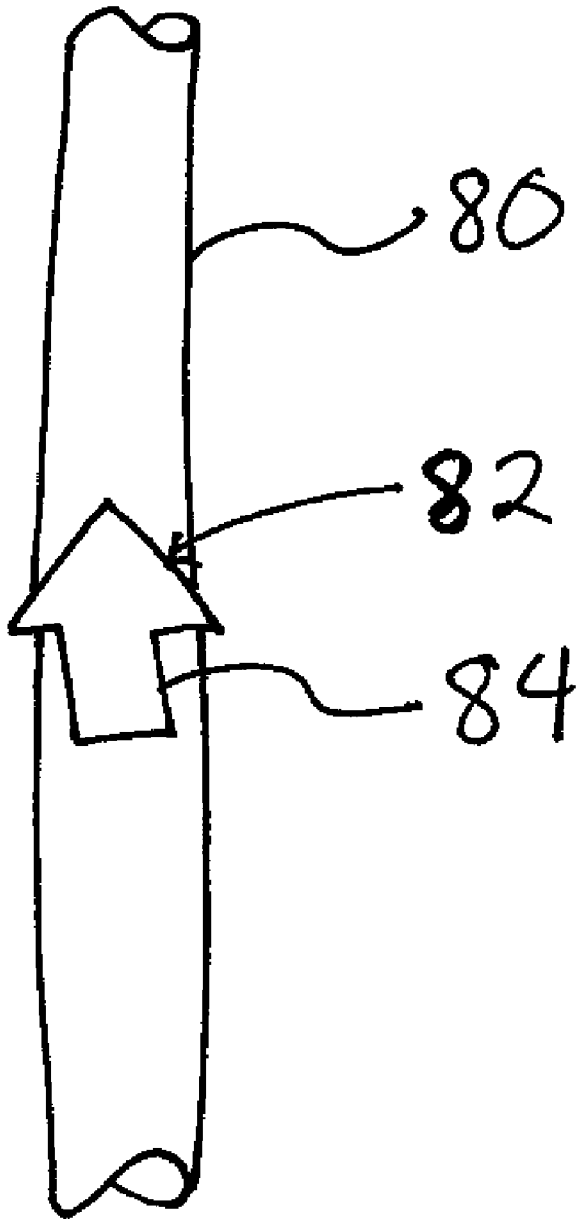
FIG. 8B is a side view of the pull cord of FIG. 8A.

In another embodiment of the present invention as shown in FIGS. 8A and 8B, a directional indicator 82 may be incorporated into a pull cord 80. Here, at least one post 86 of the directional indicator 82 is located through a pull cord 80. For example, two posts 86 may be inserted through the pull cord 80 so that the directional indicator 82 does not rotate with respect to the pull cord 80. A front portion 84 of the directional indictor 82 indicates a direction that the pull cord 80 should be pulled so that a window covering or other device is moved in a desired direction. For example, the front portion 84 may have the shape of an arrow, as shown, or any other suitable shape. In other examples, the front portion 84 may have varied colors or writing to indicate direction, as described above. Further, the directional indicator may be formed of any suitable material, such as metal or plastic.

A back portion 88 is attached to the at least one post 86 so that the directional indicator 82 is fixed to the pull cord 80. For example, the back portion 88 may screw or snap onto the post, or the back portion 88 may be a widened end section of the post 86.

In one embodiment, the directional indicator 82 is installed on the pull cord 80 during manufacture of the window covering or other device. In another embodiment, the directional indicator 82 is installed by a user after manufacturing.

In another embodiment of the present invention, the directional indicator 82 is sized and shaped so that a pull cord 80 may continue to operate through a pulley or safety device, as described above. In other words, the directional indicator 82 may be pulled through a pulley or safety device without becoming lodged in the pulley or safety device, so that the pull cord continues to operate normally.

In another embodiment, the directional indicator may be used in conjunction with a bead chain, so that the directional indicator either snaps onto the bead chain on either side of a bead or pierces a woven cord between beads of a bead chain. As one of ordinary skill in the art would realized, there are numerous suitable methods for attaching the directional indicator to a pull lead, including clips, thread, and Velcro.

Figure 11:
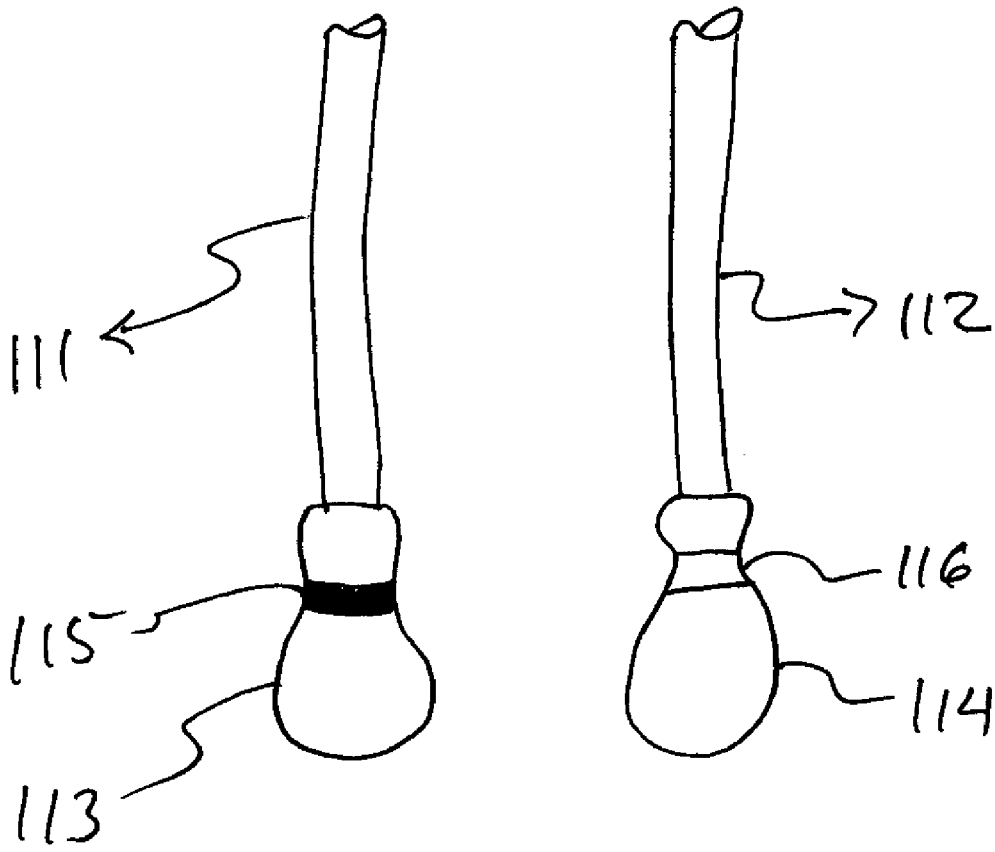
FIG. 11 is a side view of a pull cord according to another embodiment of the present invention.

In another embodiment of the present invention, directional indicators are mounted on the end of a pull lead, such as a pull chain or a pull cord, as shown in FIG. 11. Here, the directional indicators 115, 116 may be about the pull lead 111, 112 or may be through the pull lead 111, 112. For example, for window coverings or other devices that have multiple pull leads for controlling different operations, the directional indicators 115, 116 on the end of each pull lead 111, 112 have different colors or textures. Here, pulling the pull lead 111 with a directional indicator 115, which is shown on a fob 113, of one color, e.g., black, would close the window covering or other device, and pulling the pull lead 112 with a directional indicator 116, on another fob 114 of another color, e.g., white, would open the window covering or other device.

Figure 12:
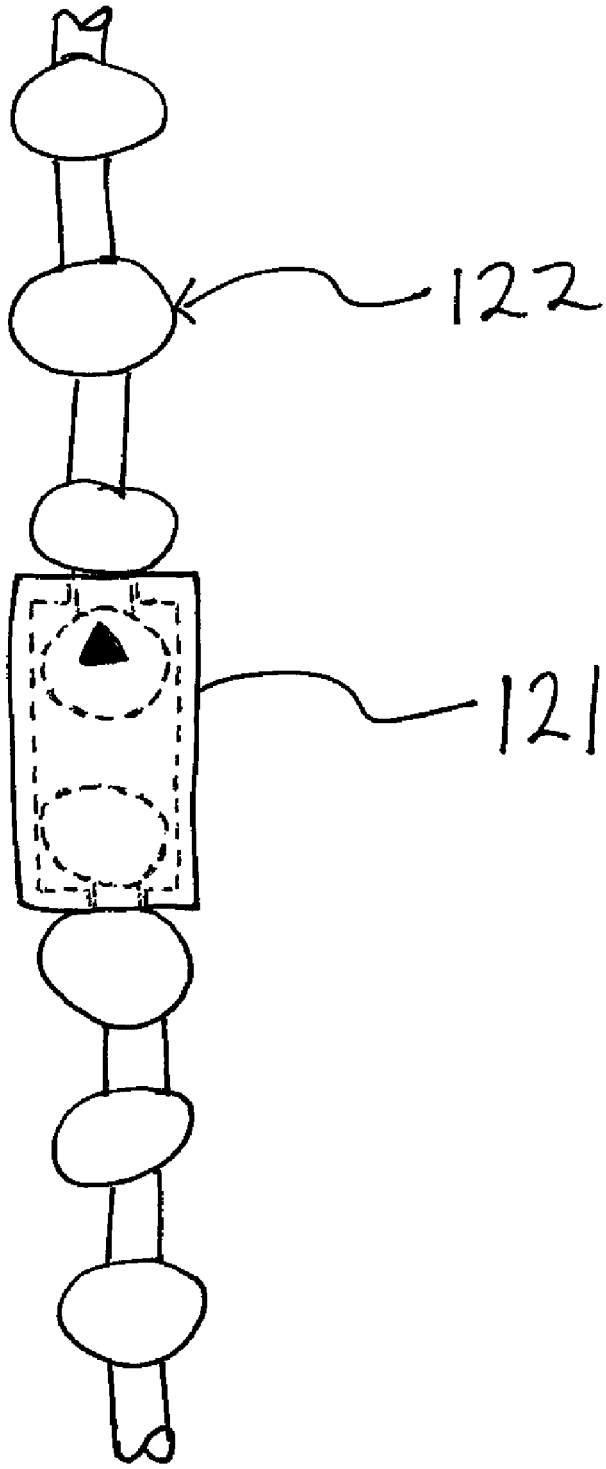
FIG. 12 is a side view of a pull cord according to another embodiment of the present invention.

In another embodiment of the present invention as shown in FIG. 12, a directional indicator 121 may be positioned about a bead chain 122. Here, a directional indicator 121 may be positioned on each side of a bead chain 122 that runs through a pulley, or a directional indicator 121 may be positioned on each of a plurality of bead chains 122, where the device is operated by multiple bead chains 122. The directional indicator 121 may be a sleeve. The directional indicator 121 may be attached to the bead chain 122 in any suitable manner, such as snapping. Further, the directional indicator 121 may be utilized to attach one end of the bead chain 122 to the other end of the bead chain 122. An arrow, color gradient, or any other direction indicating method described above may be utilized to indicate a pulling direction to operate the device.

In another embodiment of the present invention, the directional indicator 121 may be inserted into the bead chain 122 by cutting the bead chain 122 at the desired location for the directional indicator 121. Then, one end of the cut bead chain 122 is insert into one end of the directional indicator 121, such as by snapping the bead chain 122 into the directional indicator 121. Next, the other end of the cut bead chain 122 is inserted into the other end of the directional indicator 121. Now the directional indicator 121 is positioned in the bead 122 at a desired location. If the bead chain 122 is configured as a loop, the directional indicator 122 may be inserted into both sides of the loop in a similar manner. For example, an up directional indicator may be inserted into one side of the loop, and a down directional indicator may be inserted into the other side of the loop.

In another embodiment of the present invention, the directional indicator that is inserted into the bead chain 122 by cutting the bead chain may be any suitable directional indicator as described above. Further, the directional indicator may also include a bead chain section. Here, a section of the bead chain loop may be removed by cutting, which is about the same length of the bead chain section to be inserted so that the original length of the bead chain is maintained. However, a different length of bead chain section than the length of the bead chain removed may be inserted if desired.

Figure 13:
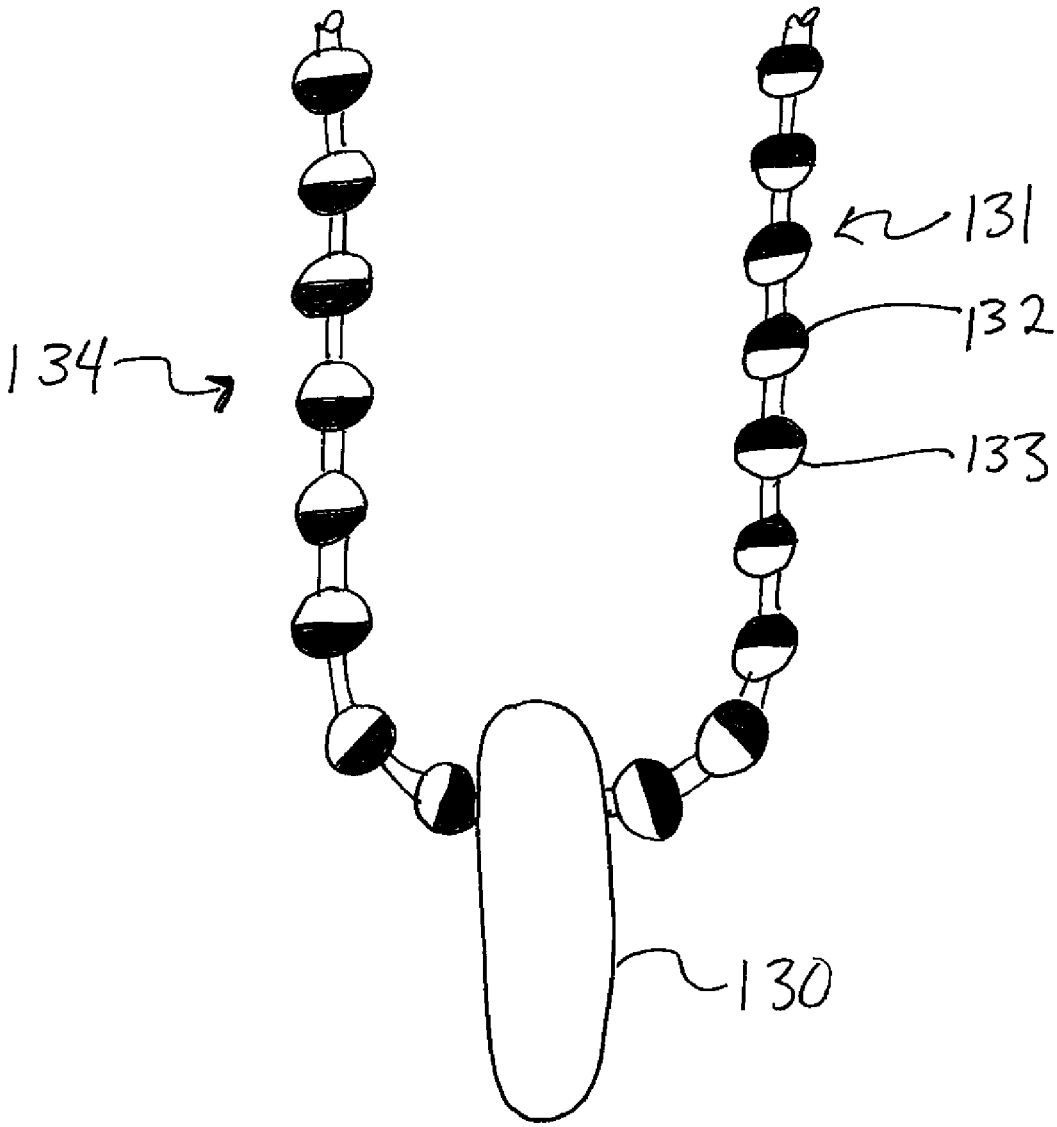
FIG. 13 is a side view of a pull chain according to another embodiment of the present invention.

In another embodiment of the present invention as shown in FIG. 13 where a bead chain loops through a safety device or pulley 130, one half of each of the beads is different from the other half of each of the beads of the bead chain, such as one half 131 is dark and the other half is light 133. Here, on one side of bead chain loop 134, the light half 133 is on top of the beads and the dark half 132 is on the bottom of the beads. On the other side of the bead chain loop 131, the dark half 132 is on the top of the beads and the light half 133 is on the bottom of the beads. Therefore, the directional indicator may be automatically in the correct location. For example, the user would pull the side of the bead chain loop 134 where the light half 133 is on top to open the window covering or other device. Further, the user would pull the side of the bead chain loop 131 where the dark half 132 is on the bottom to close the window covering or other device. One of ordinary skill in the art will appreciate that any of the other methods of directional indication described above may be adapted for use with this embodiment.

In another embodiment of the present invention where the indicator is not on an entire pull lead with multiple strands, the placement of the indicator on the lead may be determined by positioning the lead in a neutral position, e.g., in a position where the window covering or device is half way between open and closed. Next, the lighter colored or open indicator is applied to a strand of the pull lead in a position that is easily grasped. Then, the dark colored or close indicator is positioned on another strand of the pull lead at a similar position. Here, when the strand with the close indicator is pulled, the strand with the open indicator will move to a higher position, which will indicate that the open indicator strand must be pulled to open the device. This method of positioning the indicator is applicable with any of the indicators described herein.

In embodiments of the invention where the pull lead is in a continuous loop, the side of the pull lead to be pulled to open the device and the side of the pull lead to be pulled to close the device are automatically indicated, because the indicator will be reversed from one side to the other. For example, the a bead chain with a dark half and a light half, the dark half will be at the tops of the beads on one side of the bead chain, and the light half will be at the tops of the beads on the other side of the bead chain. Therefore, the user will pull the side of the bead chain where the dark half is on top of the beads to close the device, and the user will pull the side of the bead chain where the light half is on top of the beads to open the device. Further, any of the indicators described herein may be utilized in a similar manner.

Although the present invention has been described through the use of exemplary embodiments, it will be appreciated by those of skill in the art that various modifications may be made to the described embodiments that fall within the scope and spirit of the invention as defined by the claims and their equivalents appended hereto. For example, aspects shown above with particular embodiments may be combined with or incorporated into other embodiments. Therefore, a directional indicator of the types described above may be adapted to be utilized with any type of pull to provide the features desired.

What is claimed is:

1. A pull chain indicating a pulling direction of the pull chain for a desired operation of a device, the pull chain comprising:

a plurality of beads comprising:

a first bead, and a second bead; and a plurality of shanks comprising:

a first shank, wherein the first shank couples the first bead to the second bead, wherein at least the first bead comprises a directional indicator on a surface of the first bead selected from the group consisting of a variation in color, a variation in texture, and combinations thereof, so that a pulling direction is indicated for a desired operation of such device.

2. The pull chain of claim 1, wherein the first bead comprises an upper hemisphere and a lower hemisphere, and wherein the directional indicator comprises the upper hemisphere having a different appearance or a different texture from the lower hemisphere.

3. The pull chain of claim 1, wherein each of the plurality of beads comprises the directional indicator.

4. The pull chain of claim 1, wherein the first bead is a different color than the second bead.

5. The pull chain of claim 1, wherein the directional indicator comprises an upper hemisphere of the first bead having a first color, and a lower hemisphere of the first bead having a second color.

6. The pull chain of claim 1, wherein the directional indicator comprises at least one indentation on an upper hemisphere or a lower hemisphere of the first bead.

7. The pull chain of claim 1, wherein the directional indicator comprises a non-slip material.

8. The pull chain of claim 1, wherein the directional indicator comprises a color gradient.

9. The pull chain of claim 1, wherein the directional indicator comprises an object on an upper hemisphere or a lower hemisphere of the first bead.

10. The pull chain of claim 1, wherein the directional indicator comprises a decorative pattern.

11. The pull chain of claim 1, wherein the directional indicator comprises an arrow.

12. The pull chain of claim 1, wherein the directional indicator is etched into the surface of the first bead.

13. The pull chain of claim 1, wherein the directional indicator comprises a collar.

14. The pull chain of claim 1, wherein the directional indicator comprises a raised portion.

15. The pull chain of claim 1, wherein the directional indicator glows in the dark.

16. The pull chain of claim 1, wherein the directional indicator is illuminated.

17. The pull chain of claim 1, the directional indicator comprises a sleeve about the first bead.

18. The pull chain of claim 17, wherein the sleeve is clear.

19. The pull chain of claim 17, wherein the sleeve is about at least: the first bead, the second bead, and the shank.

20. The pull chain of claim 17, wherein the sleeve comprises a variation in color.

21. The pull chain of claim 17, wherein the sleeve comprises a variation in texture.

22. The pull chain of claim 17, wherein the pull chain further comprises a third bead, and wherein the sleeve is about at least the first bead and the third bead so that the first and third beads are coupled by the sleeve.

23. The pull chain of claim 1, wherein the variation in color or texture is on the first bead before the pull chain is assembled.

24. The pull chain of claim 1, wherein the variation in color or texture on the first bead is applied after the pull chain is assembled.

25. The pull chain of claim 1, wherein a first section of the pull chain comprises a first directional indicator to indicate that pulling the first section of the pull chain will result in a first operation of the device, and a second section of the pull chain comprises a second directional indicator to indicate that pulling the second section of the pull chain will result in a second operation of the device.

26. The pull chain of claim 1, wherein the directional indicator is on intermittent beads.

27. The pull chain of claim 1, wherein the directional indicator is on at least one shank.

28. A pull lead indicating a pulling direction of the pull lead for a desired operation of a device, the pull lead comprising: a directional indicator selected from the group consisting of a variation in color, a variation in texture, and combinations thereof, so that a pulling direction is indicated for a desired operation of such device.

29. The pull lead of claim 28, wherein the pull lead comprises a bead chain comprising:

a plurality of beads comprising:

a first bead, and a second bead; and a plurality of shanks comprising:

a first shank, wherein the first shank couples the first bead to the second bead, wherein at least the first bead comprises the directional indicator.

30. The pull lead of claim 29, wherein the first shank further comprises the directional indicator.

31. The pull lead of claim 28, wherein the pull lead comprises a pull cord.

32. The pull lead of claim 28, wherein the pull lead comprises a link chain.

33. The pull lead of claim 28, wherein the directional indicator comprises a non-slip material.

34. The pull lead of claim 28, wherein the directional indicator comprises a color gradient.

35. The pull lead of claim 28, wherein the directional indicator comprises a decorative pattern.

36. The pull lead of claim 28, wherein the directional indicator comprises an arrow.

37. The pull lead of claim 28, wherein the directional indicator comprises a raised portion.

38. The pull lead of claim 28, wherein the directional indicator glows in the dark.

39. The pull lead of claim 28, wherein the directional indicator is illuminated.

40. The pull lead of claim 28, the directional indicator comprises a sleeve about the pull lead.

41. The pull lead of claim 39, wherein the sleeve is clear.

42. The pull lead of claim 39, wherein the sleeve comprises a variation in color.

43. The pull lead of claim 39, wherein the sleeve comprises a variation in texture.

44. The pull lead of claim 28, wherein a first section of the pull lead comprises a first directional indicator to indicate that pulling the first section of the pull lead will result in a first operation of the device, and a second section of the pull lead comprises a second directional indicator to indicate that pulling the second section of the pull lead will result in a second operation of the device.

45. The pull lead of claim 28, wherein the directional indicator is positioned at an end of the pull lead.

* * * * *